United States Patent [19]

Mayama

[11] Patent Number: 4,837,985

[45] Date of Patent: Jun. 13, 1989

[54] REVOLVING GRINDING TOOL

[75] Inventor: Tatsushige Mayama, Osaka, Japan

[73] Assignee: Nippon Tenshashi Kabushiki, Osaka, Japan

[21] Appl. No.: 197,139

[22] Filed: May 23, 1988

[51] Int. Cl.[4] ..... B24B 45/00

[52] U.S. Cl. ..... 51/364; 51/358; 51/370

[58] Field of Search ..... 51/364, 372–379, 51/358, 365, 366, 370, 371

[56] References Cited

U.S. PATENT DOCUMENTS

| | | | |
|---|---|---|---|
| 551,019 | 12/1895 | Webster | 51/374 |
| 1,948,643 | 2/1934 | Bertrand | 51/373 |
| 3,623,280 | 11/1971 | Chesnot | 51/370 |
| 3,905,080 | 9/1975 | Bond | 29/76 |
| 4,456,500 | 6/1984 | Ibata | 156/634 |

*Primary Examiner*—Frederick R. Schmidt
*Assistant Examiner*—Maurina Rachuba
*Attorney, Agent, or Firm*—Griffin, Branigan & Butler

[57] ABSTRACT

A revolving grinding tool (1) comprises a support (2) mounting on a shaft (10) and an interrupted resilient cylindrical abrasive body (4) mounted on a circumferential cylindrical surface (8) of the support with tongue (5) formed on one butting end of the abrasive body engaging a groove in the circumferential cylindrical surface of said support. Recesses (6) formed on one butting end of the abrasive body and tabs (7) formed on the other end compelment with each other and enable substantially continuous grinding revolution.

15 Claims, 4 Drawing Sheets

REVOLVING GRINDING TOOL

BACKGROUND OF THE INVENTION

This invention relates to revolving grinding tools that are on grinding robots, portable grinders, and the like, which are used for grinding metallic and nonmetallic materials.

Prior art revolving grinding tools include those disclosed in U.S. Pat. No. 3,905,080 and counterpart Japanese Patent Provisional Publication No. 13,796/74. A conventional grinding tool normally comprises a support with an elastic layer on its surface and a cylindrical abrasive body without butting ends having numberous grinding grains on its surface, covering the elastic layer. In such a conventional grinding tool, as the support revolves, the elastic layer expands by centrifugal force, thereby engaging the abrasive body with frictional force. Thus, as the support revolves, the abrasive body revolves with it. However, torque transmission depending on frictional force between the elastic layer and the abrasive body is not sufficient and this insufficiency has been a disadvantage to conventional revolving grinding tools.

Therefore, the present invention has been developed to solve the aforesaid disadvantage and to provide a rovolving grinding tool with reliable torque transmission.

SUMMARY

A revolving grinding tool according to the invention comprises a revolving cylindrical support equipped with a groove or grooves and an interrupted cylindrical abrasive body, having numerous abrasive grains on its surface, loaded onto the cylindrical support. One butting end of the abrasive body has tabs and the other butting end has recesses, both being arranged to complement each other, and on the ends of the tabs and/or unrecessed parts are formed radially-directed tongues for engaging the groove or grooves of the support.

As the support revolves in a specified direction, torque is transmitted to the abrasive body via engagement of the tongues and groove(s), thus revolving the abrasive body in the direction of revolution of the support. The revolving abrasive body is applied to a material which is ground by abrasive grains on the revolving abrasive body. Because tabs and recesses of the abrasive body are arranged to complement each other, abrasive grains are substantially evenly distributed on the surface, enabling continuous grinding.

BRIEF DESCRIPTION OF THE DRAWINGS

The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
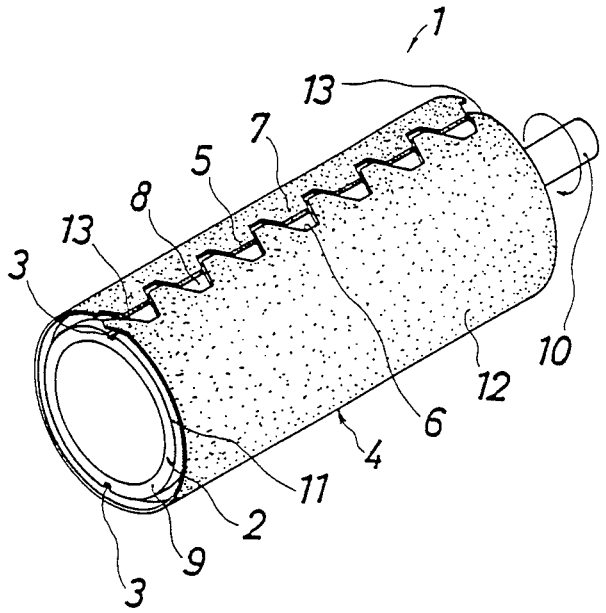
FIG. 1 is a perspective view of a revolving grinding tool of this invention.
Figure 2:
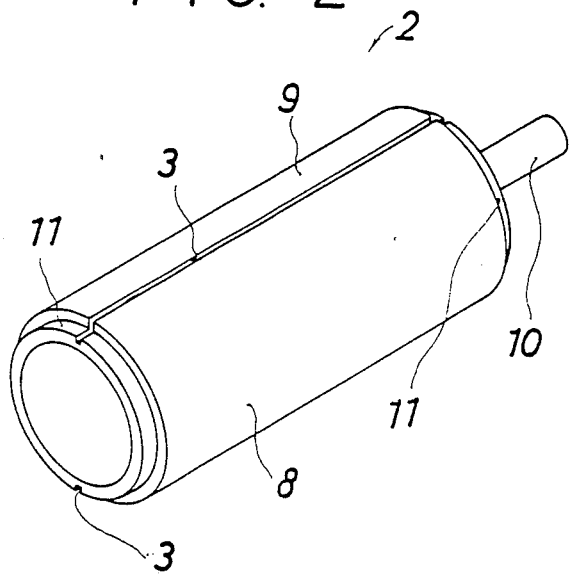
FIG. 2 is a prespective view of a support for the FIG. 1 embodiment.
Figure 3:
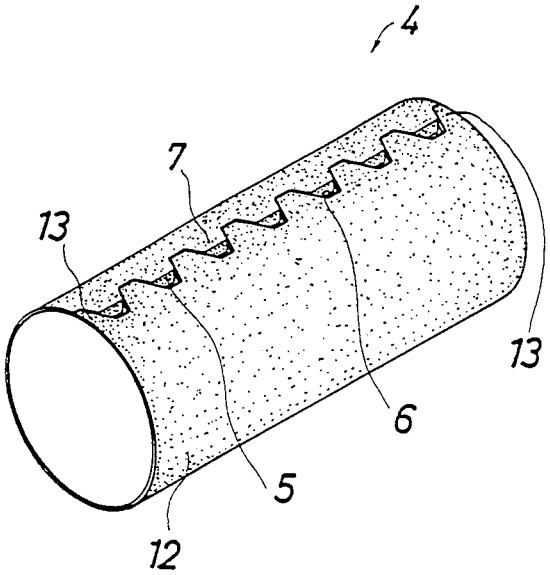
FIG. 3 is a perspective view of an abrasive body for the FIG. 1 embodiment.

A revolving grinding tool 1 mainly comprises a support 2 defining a groove or grooves 3 and an abrasive body 4 having recesses 6 and tabs 7.

The support 2 has a cylindrical surface 8 which revolves. In a preferred embodiment, the support 2 is in the form of a cylinder 9 with one open end and one closed end, and a shaft 10 being connected to the closed end. In addition to the cylindrical external surface 8, the cylinder 9 has recessed steps 11 at opposite ends thereof. The shaft 10 can be attached to, or detected from, a revolving driving shaft (not shown) of a grinding robot, portable grinder, desktop grinder, or the like. The grooves 3 are recessed into the cylindrical surface 8. In this preferred embodiment, two grooves 3 are located 180° apart on the cylinder 9 with a specific radial depth toward a central axis of the cylinder 6. The grooves 3 extend longitudinally in the axial direction and have open ends.

The abrasive body 4 is a cylindrically-formed abrasive member having numerous abrasive grains 12 on its surface and is to be installed on the cylindrical surface 8 of the support 2. A curved metallic grinding sheet having on its external surface numerous integrated abrasive grains 12 is utilized. Metallic abrasive sheets suitable for this embodiment are disclosed, for example, in Japanese Patent Provisional Publication No. 151,477/83 (counterpart of U.S. Pat. No. 4,456,500) and the like. The abrasive body 4 is so curved that its inside diameter is appropriately small so that the abrasive body 4 may be securely clamped onto the cylindrical surface 8 of the support 2. Tongues 5 on butting ends or ends of the abrasive body 4 engage with one of the grooves 3. In this embodiment, the tongues 5 are provided on only one butting end of the abrasive body 4 and are formed by bending ends of the tabs 7 inwardly at a right angle, that is, opposite to the abrasive grains 12. The recesses 6 are formed at equal intervals along the longitudinal axis. The tabs 7 are formed on the other butting end of the abrasive body 4 so that the tabs 7 and recesses 6 complement each other. In this embodiment, seven trapezoidal tabs are formed at equal intervals along the axis. Both sides of either butting end of the abrasive body 4 can be bent into the recessed steps 11 to form stops 13 to prevent the abrasive body 4 from sliding off of the cylinder 9.

Operation of the revolving grinding tool 1 according to the present invention is hereunder described, referring to the construction described above. The abrasive body 4 is attachable to and detachable from the support 2. While being attached, the abrasive body 4 is expanded and this state is maintained while the cylinder 9 of the support 2 is inserted along its axis. After insertion, the stops 13 are bent inwardly to prevent the abrasive body 4 from sliding off longitudinally. The abrasive body 4 shrinks radially inwardly due to its resilience and its internal surface fits snugly onto the external surface 8 of the support 2. The tongues 5 engage with one of the grooves 3, the tabs 7 complement with recesses 6, and the stops 13 grip the recessed steps 11. A reverse process is followed when detaching the abrasive body 4 from the support 2 except that the stop 13 is left bent.

Once the abrasive body 4 is mounted on the support 2 the shaft 10 is connected with a revolving axle (not shown) of a revolving grinding tool, and the support 2 is revolved in a direction as shown by an arrow in FIG. 1 so that the tongues 5 take the leading position of the revolving abrasive body 4.

As the support 2 revolves, torque is transmitted to the abrasive body 4 via the engagement of one of the groove 3 with the tongues 5 to thereby revolve the abrasive body 4 in the same direction as the support 2. The revolving abrasive body 4 is applied to a material to be ground, and it is so ground by the abrasive grains 12.

Although the recesses 6 and the tabs 7 are complementary to each other they are not in perfect contact. However, the abrasive grains 12 are substantially continuously distributed in the circumferential direction on the abrasive surface, enabling continuous grinding of materials. Because the stops 13 grip the recessed steps 11, the abrasive body 4 does not slide off the support 2 in the direction of the axis. Although the support 2 is described as being a hollow cylinder in the preceding embodiment, it can also be not hollow, but rather a solid cylinder. Although the grooves 3 on the support 2, are continuous in the preceding embodiment, they could be segmented to conform to the tongues 5. In this case, engagement therebetween would work to prevent the abrasive body from sliding off longitudinally. The tongues 5 formed at the ends of the tabs 7 could also be formed on the other butting end having recesses. The tongues 5, which are formed by bending, could be formed by joining separate parts through welding. The recesses 6 and tabs 7 need not be trapezoidal in shape but could be triangular, rectangular, or semi-circular. The number of recesses 7 and tabs 7 could be more or less than seven. The abrasive body 4 in the preceding embodiment, does not have abrasive grains on an inner surface which is in contact with the support; however, the abrasive body may have abrasive grains on this surface too. The abrasive grains 12 on the abrasive body 4, being formed integrally on the abrasive body 4 in the preceding embodiment, can be made separately and bonded to a metallic sheet or the like. The support 2 and the abrasive body 4 can be control or barrel-shaped, so that their diameters change along the axis.

Figure 5:
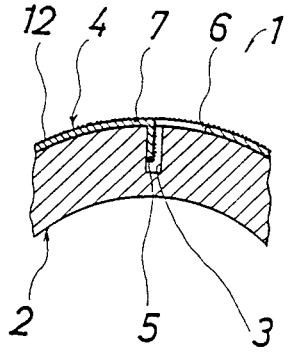
FIG. 5 is a magnified cross-sectional view showing engagement of a groove and tongues for the FIG. 1 embodiment.
Figure 4:
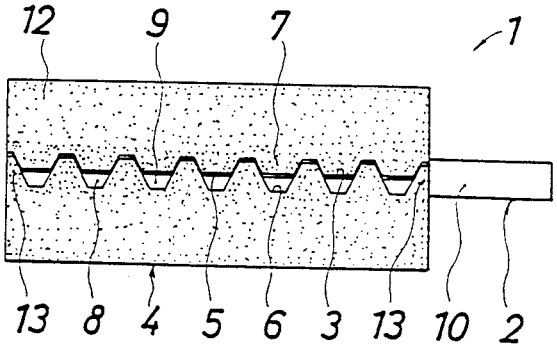
FIG. 4 is a plan view of the revolving grinding tool of FIG. 1.
Figure 6:
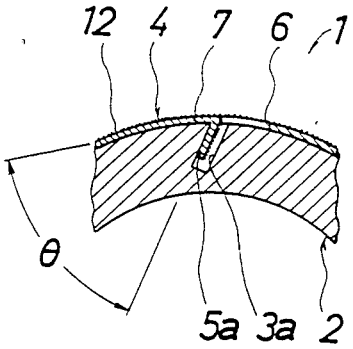
FIG. 6 is a magnified cross-sectional view similar to FIG. 5 of a second embodiment of the invention.

The grooves 3 on the support 2 and the tongues 5 on the abrasive body 4, rather than being formed at a right angle to a tangential plane as is shown in FIG. 5, could be formed at an acute angle to a tangential plane as is shown by a groove **3*a* and tongues 5*a* in FIG. 6**.

Figure 7:
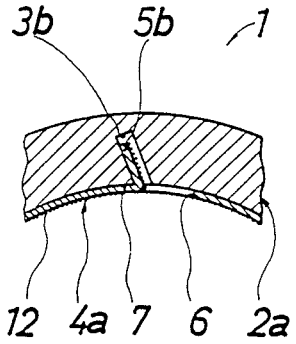
FIG. 7 is a magnified cross-sectional view similar to FIG. 5 of a third embodiment of the invention.

In an alternate embodiment an abrasive body **4*a* is attached to an internal surface of the support 2*a* as is illustrated in FIG. 7. In this case, a groove 3*b* is cut into an internal surface of a support 2*a*, while tongues 5*b* are bent outward and the abrasive grains 12 are disposed on an internal surface of the abrasive body 4**.

Figure 8:
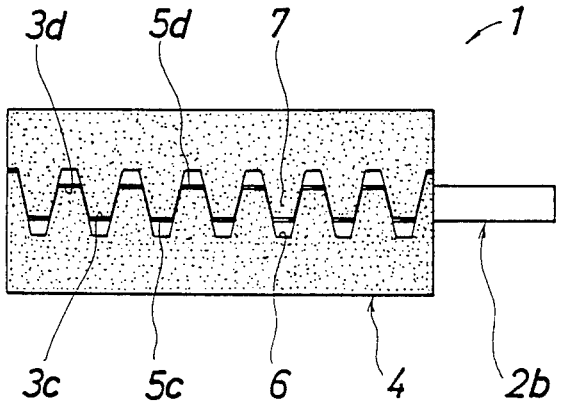
FIG. 8 is a plan view of a forth embodiment of the invention.
Figure 9:
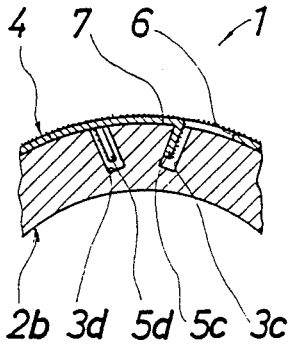
FIG. 9 is a magnified cross-sectional view of the structure of FIG. 8.

FIGS. 8 and 9 illustrate an embodiment wherein tongues **5*c* and d are formed on both butting ends and two adjacent grooves 3*c* and d are formed on a support 2*b*** so as to engage the tongues.

Figure 10:
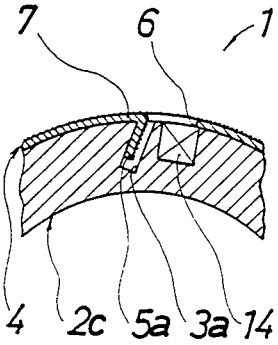
FIG. 10 is a magnified cross-sectional view similar to FIG. 5 of a fifth embodiment of the invention.

FIG. 10 illustrates an embodiment wherein the tongues **5*a* are formed on one butting end and groove 3*a* is so formed on a support 2*c* to engage the tongues. Simultaneously, a permanent magnet 14 is embedded in the support 2*c* near the groove 3*a*** so as to attract the other butting end.

Figure 11:
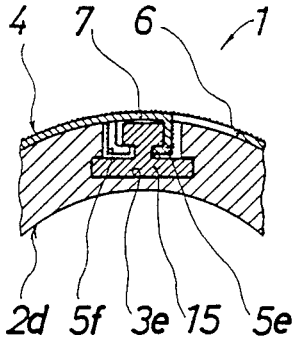
FIG. 11 is a magnified cross-sectional view similar to FIG. 5 of a sixth embodiment of the invention.

FIG. 11 illustrates an embodiment wherein L-shaped tongues **5*e* and 5*f* are formed on both butting ends of the abrasive body 4. An inverted T-shaped groove 3*e* is formed on a support 2*d* to engage the tongues, and inserted therein is an inverted T-shaped key 15**, shaped like a section of railway rail, to secure the engagement.

Figure 12:
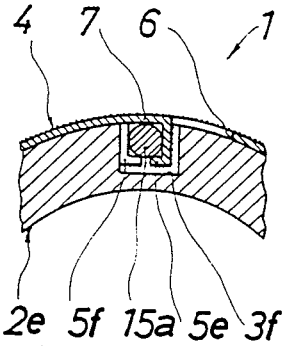
FIG. 12 is a magnified cross-sectional view similar to FIG. 5 of a seventh embodiment of the invention.

FIG. 12 illustrates an embodiment wherein L-shaped tongues **5*e* and 5*f* are formed on both butting ends of the abrasive body 4. A groove 3*f* is formed on a support 2*e* to engage the tongues, and a round bar key 15*a*** is inserted therein to secure the engagement.

The preceding embodiments illustrated in FIGS. 8 through 12 prevent the expansion of the abrasive body 4 even under huge centrifugal force and, except for the embodiment illustrated in FIG. 10, these embodiments eliminate the necessity of remounting the abrasive body 4 even when the shaft 10 revolves in a reverse direction.

Figure 13:
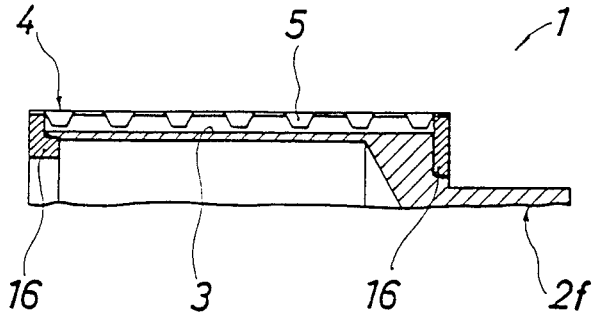
FIG. 13 is a magnified longitudinal section of a major portion of an eighth embodiment of the invention.
Figure 14:
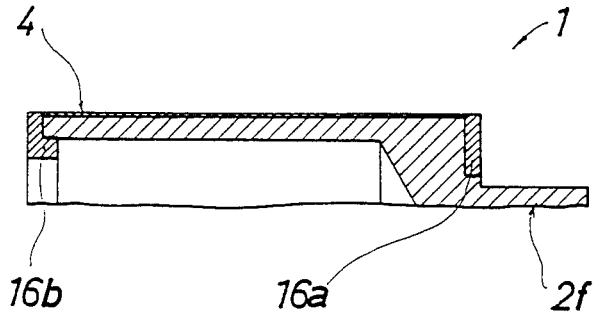
FIG. 14 is a magnified longitudinal sectin of a major portion of a ninth embodiment of the invention; and, FIG. 15 is a magnified longitudinal section of a major portion of a tenth embodiment of the invention.
Figure 15:
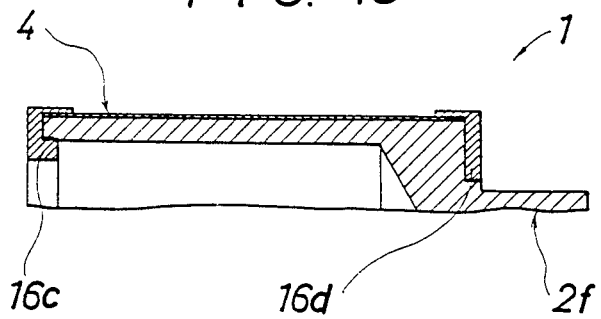

The engagement of the recessed steps 11 on the support 2 and the stops 13 on the abrasive body 4, which prevents the abrasive body from sliding off, may be omitted or may be arranged as shown in FIGS. 13 through 15.

FIG. 13 illustrates an embodiment wherein stops 16 are provided on a support 2f to engage the tongues 5 of the abrasive body 4.

FIG. 14 illustrates an embodiment wherein flanges 16a and b, which work as stops by supporting both sides of the abrasive body 4, are on the support 2f.

FIG. 15 illustrates an embodiment wherein stops **16*c* and d on the support 2*f*, are in contact with and cover both ends of the abrasive body 4, whereby the stops prevent the diameter of abrasive body 4** from being enlarged.

The embodiments of the invention in which an exclusive property or privilege are claimed are defined as follows:

1. A revolving grinding tool comprising:

a cylindrical support having a cylindrical surface with a groove in the cylindrical surface;

an interrupted, metallic, cylindrical abrasive sleeve having sides parallel to each other, having first and second butting ends each being substantially at a right angle to said sides, having numerous abrasive grains on its surface, and being mounted on said cylindrical support, said butting ends being unattached to one another, said cylindrical abrasive sleeve having a smaller diameter than the support such that said sleeve must be expanded to place it on said support;

radially-directed tongues formed on one of said first and second butting end of said abrasive body for engaging said groove, said tongues and groove being sized and shaped to secure said abrasive body onto said support during rotation of said support and thereby prevent relative rotation therebetween when said abrasive body is used for grinding;

recesses formed on said second butting end of said abrasive body; and, tabs formed on the first butting end for complementing said recesses.

2. A revolving grinding tool as claimed in claim 1, wherein said groove on said support and said tongues of said abrasive sleeve have interengaging side surfaces that are at a right or lesser angle to attachment areas at which said tongues are attached to said one of said first and second butting ends.

3. A revolving grinding tool as claimed in claim 1, wherein said groove on said support is formed, and said tongues are bent, at acute angles to a tangential plane of said cylindrical surface.

4. A revolving grinding tool as claimed in claim 1, wherein said cylindrical surface is an external circumferential surface of said support.

5. A revolving grinding tool as claimed in claim 1, wherein tongues are formed on only one butting end of said abrasive sleeve for engaging said groove.

6. A revolving grinding tool as claimed in claim 1, wherein tongues are formed on both butting ends of said abrasive sleeve and two grooves are formed on said support for engaging said tongues.

7. A revolving grinding tool as claimed in claim 1, wherein tongues are formed on one butting end of said abrasive sleeve for engaging said groove, while a permanent magnet is embedded in said support near said groove for attracting the other butting end of said abrasive sleeve.

8. A revolving grinding tool as claimed in claim 1, wherein L-shaped tongues are formed on both butting ends of said abrasive sleeve and one inverted T-shaped groove is formed on said support for engaging said tongues and wherein an inverted T-shaped key is mounted in said T-shaped groove to secure the engagement.

9. A revolving grinding tool as claimed in claim 1, wherein L-shaped tongues are formed on both butting ends of said abrasive sleeve and a round bar key is mounted in said groove to secure engagement between said tongues and said groove.

10. A revolving grinding tool as claimed in claim 1, wherein both ends of said support are respectively provided with a recessed step and both ends of said abrasive sleeve have corresponding stops bent inwardly to engage the recessed steps on said support.

11. A revolving grinding tool as claimed in claim 1, wherein said support is provided with a separate retainer member which is securely in contact with said tongues of said abrasive sleeve to prevent said sleeve from sliding off.

12. A revolving grinding tool as claimed in claim 1, wherein both ends of said support have flange-shaped retainers thereon to prevent said abrasive sleeve from sliding off.

13. A revolving grinding tool as claimed in claim 1, wherein both ends of said support are in contact with retainers which cover both ends of said abrasive sleeve to prevent said body from sliding off longitudinally.

14. A revolving grinding tool as in claim 1, wherein said groove has at least one side surface extending a substantial distance into said support at a right or lesser angle to an attachment area of said one of said first and second butting ends on which said tongues are attached and wherein said tongues are formed by bending ends of said tabs, said ends being bent to extent at a right or lesser angle to said attachment area of said tongues a substantial distance into said groove and thereby make flat contact with said at least said one side.

15. A revolving grinding tool as in claim 5, wherein said groove has at least one side surface extending a substantial distance into said support at a right or lesser angle to an attachment area of said one of said first and second butting ends on which said tongues are attached and wherein said tongues are formed by bending ends of said tabs, said ends being bent to extend at a right or lesser angle to said attachment area of said tongues a substantial distance into said groove and thereby make flat contact with said at least one side.

* * * * *